United States Patent [19]

Takabatake

[11] Patent Number: 4,562,622

[45] Date of Patent: Jan. 7, 1986

[54] SLIDE FASTENER SLIDER

[75] Inventor: Hideo Takabatake, Namerikawa, Japan

[73] Assignee: Yoshida Kogyo K.K., Tokyo, Japan

[21] Appl. No.: 505,964

[22] Filed: Jun. 20, 1983

[30] Foreign Application Priority Data

Jun. 21, 1982 [JP] Japan ..... 57-92596[U]

[51] Int. Cl.[4] ..... A44B 19/00

[52] U.S. Cl. ..... 24/427; 24/428; 24/415

[58] Field of Search ..... 24/415, 418, 419, 420, 24/426, 427

[56] References Cited

U.S. PATENT DOCUMENTS

| | | | |
|---|---|---|---|
| 2,532,367 | 12/1950 | Lyeth | 24/428 |
| 2,542,453 | 2/1951 | Anderson | 24/428 |
| 2,875,491 | 3/1959 | Morin | 24/427 |
| 3,822,443 | 7/1974 | Yoshida | 24/427 |
| 3,872,553 | 3/1975 | Moertel | 24/428 |
| 3,925,857 | 12/1975 | Kihara | 24/427 |
| 4,055,876 | 11/1977 | Ackermann et al. | 24/421 |
| 4,409,705 | 10/1983 | Yuunaga | 24/415 |
| 4,455,722 | 6/1984 | Oda | 24/415 X |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A slide fastener slider comprises a slider body including a pair of upper and lower wings defining therebetween a Y-shaped guide channel, the lower wing having a pair of lateral flanges and a pair of corner ledges, each extending along an inner face of the respective flange through its length. The slider also has a pair of auxiliary ledges on the inner face of the lower wing adjacent to respective front ends of the flanges, each of the auxiliary ledges having a flat top surface disposed below the respective corner ledge for being engageable with the outer or lower leg portions of the respective fastener element row so as to prevent the coupling head portion of the individual fastener element from projecting into an aperture in the upper wing, through which aperture a fastener-element locking pawl is projectable, while the opposed rows of fastener elements are being coupled to close the slide fastener.

1 Claim, 11 Drawing Figures

SLIDE FASTENER SLIDER

BACKGROUND OF THE INVENTION

1. Field of the Invention

The present invention relates to a slider for a slide fastener.

2. Prior Art

A known slide fastener comprises a pair of fastener stringers including a pair of stringer tapes carrying along their longitudinal edges a pair of rows of fastener elements; each row of the fastener elements is in the form of a coiled plastic filament attached by sewn stitches to the respective tape on one face thereof. Each of such fastener elements has a substantially oval contour and hence tends to roll or tilt in a slider when a lateral pull is exerted on the tape. This rolling causes not only unstable coupling of the opposed rows of fastener elements but also non-smooth movement of the slider.

In an attempt to solve this problem, as shown in Yunnaga U.S. Pat. No. 4,419,705 filed June 2, 1981, an improved slider has been proposed in which a pair or corner ledges is disposed on an upper wing adjacent to a pair of lateral flanges respectively, each corner ledge extending along an inner face of the respective flange throughout its length. Each corner ledge has an inwardly sloping surface engageable with leg portions of the respective row of fastener elements which leg portions are disposed remotely from the tape and face the flanged upper wing. However, the prior slider cannot prevent rolling of the fastener elements, in case it is used in a slide fastener in which a pair of rows of coiled filamentary fastener elements is disposed on the underside of the respective stringer tapes. Furthermore, if the flange and corner structure of Yunnaga were modified to be disposed on the lower flange to accommodate fastener elements on the underside of the tapes, the result would still be unsatisfactory. In such particular modified slide fastener, as shown in FIG. 1 of the accompanying drawings, both the lateral flanges 6 (only one shown for clarity) and the corner ledges 7 (only one shown for clarity) are disposed on the lower wing 2 of the slider body, and the upper wing 1 has an aperture 1*a* through which a fastener-element locking pawl of the slider is projectable in response to pivotal movement of a slider pull tab pivotally mounted on the upper wing 1. When a lateral pull in the direction of an arrow 8 is exerted on one tape 3 while the opposed rows of fastener elements 4 attached to the respective tapes 3 by sewn stitches 5 are being coupled to close the slide fastener, the individual fastener elements 4 on the one tape 3 tend to roll or tilt in the guide channel of the slider. At that time, the outer or lower leg portion 4*b* of the fastener element 4, as the latter arrives at the aperture 1*a*, falls on the inner face 2*a* of the lower wing 2 so that the coupling head portion 4*a* partly projects into the aperture 1*a*, thus causing not only non-smooth movement of the slider but also non-uniform spaces between the fastener elements 4.

SUMMARY OF THE INVENTION

According to the present invention, a slider for a slide fastener comprises a slider body including a pair of upper and lower wings defining therebetween a Y-shaped guide channel, the lower wing having a pair of lateral flanges and a pair of corner ledges each extending along an inner face of the respective flange through its length. The slider also has a pair of auxiliay ledges on the inner face of the lower wing adjacent to respective front ends of the flanges, each of the auxiliary ledges having a flat top surface disposed below the respective corner ledge for being engageable with the outer or lower leg portions of the respective fastener element row so as to prevent the coupling head portion of the individual fastener element from projecting into an aperture of the upper wing, through which aperture a fastener-element locking pawl is projectable, while the opposed rows of fastener elements are being coupled to close the slide fastener.

It is therefore an object of the invention to provide a slide fastener slider suitable for a slide fastener in which a pair of rows of coiled filamentary fastener elements is attached to the respective tapes on the underside thereof.

Another object of the invention is to provide a slide fastener slider which enables smooth and stable coupling of the opposed rows of fastener elements with uniform element-to-element pitches.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
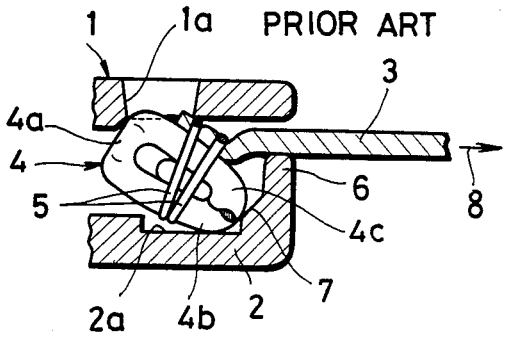
FIG. 1 is a fragmentary transverse cross-sectional view illustrating a prior art problem.
Figure 2:
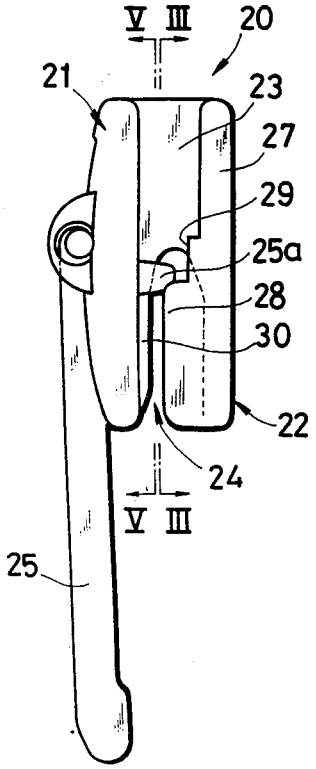
FIG. 2 is a side view of a slide fastener slider embodying the present invention.
Figure 3:
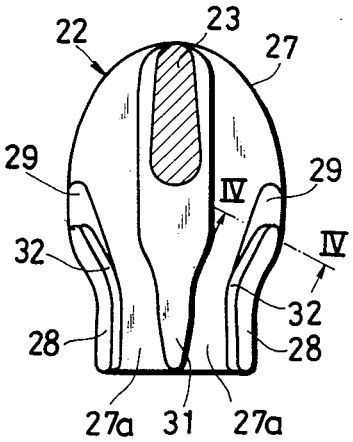
FIG. 3 is a cross-sectional view taken along line III—III of FIG. 2.
Figure 5:
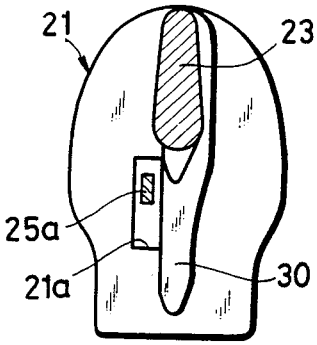
FIG. 5 is a cross-sectional view taken along line V—V of FIG. 2.
Figure 4:
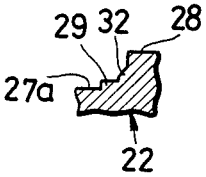
FIG. 4, is a fragmentary enlarged cross-sectional view taken along line IV—IV of FIG. 3.
Figure 6:
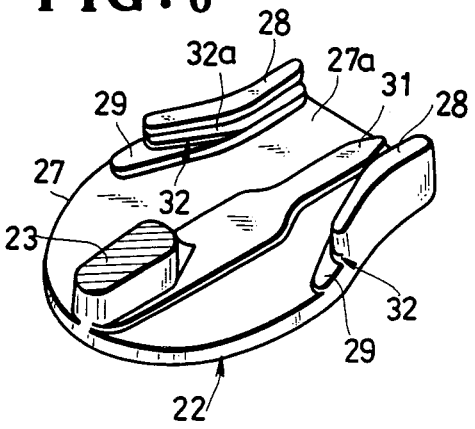
FIG. 6 is a perspective view, partly in cross section, of a lower wing of the slider.
Figure 7:
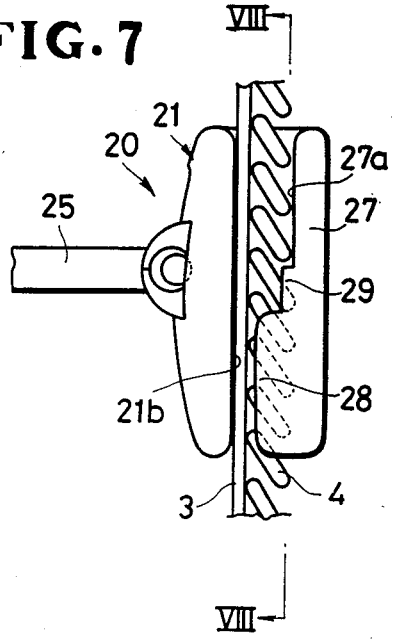
FIG. 7 is a fragmentary side view of the slider having been threaded on a pair of fastener stringers.

The principles of the present invention are particularly useful when embodied in a slide fastener slider such as shown in FIG. 2, generally indicated by the numeral 20. The slider 20 is suitable for a slide fastener which comprises a pair of opposed stringers having a pair of rows of fastener elements 4, 4 (FIGS. 7 through 11) attached to a pair of tapes 3, 3 (FIGS. 7, 10 and 11) along their resective inner longitudinal edges by means of sewn stitches 5 (FIGS. 10 and 11), each row of fastener elements 4 being disposed on the underside of the respective tape 3 as shown in FIGS. 10 and 11. Each row of fastener elements 4 is a coiled plastic filament of substantially oval contour; each individual fastener element has a coupling head portion 4a, an upper leg portion 4c disposed adjacent to the tape 3, and a lower leg portion 4b disposed remotely from the tape 3, as shown in FIGS. 8–11.

As shown in FIGS. 2, 3, 5 and 6, the slider 20 comprises a slider body including a pair of parallel spaced upper and lower wings 21, 22 joined at their front end by a neck 23 to define a Y-shaped guide channel 24 (FIG. 2) between the two wings 21, 22 for the passage of the opposed rows of fastener elements 4, 4 of the slide fastener. The upper wing 21 has an aperture 21a (FIGS. 5, 8–11) opening into the guide channel 24. A slider pull tab 25 is pivotally mounted on the upper wing 21 and has a locking pawl 25a which is projectable, in response to pivotal movement of the pull tab 25, through the aperture 21a into the guide channel 24 to engage the fastener elements 4. The lower wing 22 has a pair of flanges 28, 28 projecting respectively from opposite lateral edges thereof toward and terminating short of the upper wing 21.

The lower wing 22 has a first flat land 31 (FIGS. 3 and 6) disposed centrally between the flanges 28, 28 and extending longitudinally of the guide channel 24 and slidably engageable with the coupling head portions 4a of the fastener elements 4 on their lower side, as shown in FIGS. 10 and 11. The upper wing 21 has a second flat land 30 (FIG. 5) disposed opposite to the first land 31 of the lower wing 22 and locatable between the inner longitudinal edges of the tapes 3, 3.

The lower wing 22 has a pair of corner ledges 32, 32 on the inner face 27a of a base 27 adjacent to the flanges 28, 28 respectively, each of the corner ledges 32 extending along the inner face of the respective flange 28 through its length and having a fastener-element pressure surface 32a (FIG. 6) engageable with the lower leg portions 4b of the fastener elements 4. The pressure surface 32a is laterally inclined to fit a part of the oval contour of the individual fastener element 4 which part is defined by the outer end of the lower leg portion.

The lower wing 22 also has a pair auxiliary ledges 29, 29 on the inner face 27a of the base 27 adjacent to respective front ends of the flanges 28, 28, each of the auxiliary ledges 29 extending from a midportion of the respective corner ledge 32 beyond the front end thereof. Each auxiliary ledge 29 has a uniform height throughout its whole area and thus a flat top surface disposed below the sloping surface 32a of the respective corner ledge 32 for being engageable with the lower leg portion 4b of the respective fastener element row 4.

Figure 8:
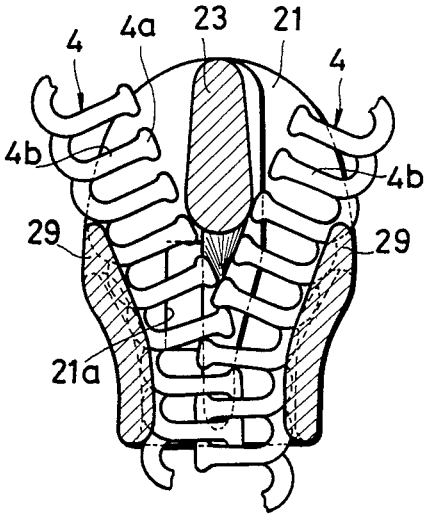
FIG. 8 is a cross-sectional view taken along line VIII—VIII of FIG. 7.
Figure 9:
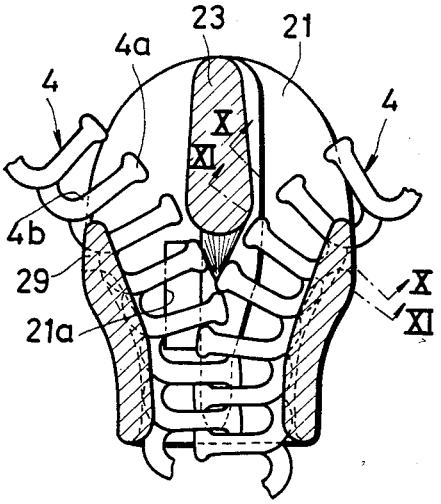
FIG. 9 is a view similar to FIG. 8 showing the opposed fastener stringer, with stringer tapes omitted, having been pulled in opposite lateral directions.
Figure 10:
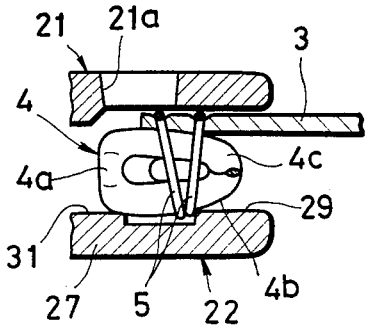
FIG. 10 is a fragmentary cross-sectional view taken along line X—X of FIG. 9.
Figure 11:
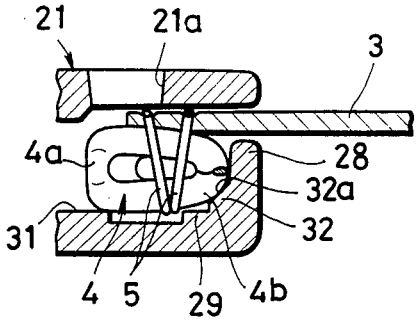
FIG. 11 is a fragmentary cross-sectional view taken along line XI—XI of FIG. 9.

FIG. 8 illustrates the opposed stringers not having been pulled in opposite lateral directions, and FIGS. 9–11 illustrate the opposed stringers having been pulled in opposite lateral directions. In either case, the lower leg portions 4b of the fastener elements 4 adjacent the respective front halves of the corner ledges 32,32 rest on the auxiliary ledges 29,29, with the long axis of their oval shape lying parallel to the inner face 27a of the lower wing's base 27. In the latter case in particular, even when relatively strong lateral pulling forces are exerted on the opposed tapes 3,3 while the opposed stringers are being coupled to close the slide fastener, the individual fastener elements 4 adjacent the respective front ends of the corner ledges 32,32 are prevented, by the auxiliary ledges 29,29, from rolling or tilting with respect to the inner face 27a of the lower wing's base 27. The coupling head portions 4a of the fastener elements 4 are thus prevented from projecting into the aperture 21a of the upper wing 21.

With the slider 20 having the auxiliary ledges 29, it is possible to interengage or couple the opposed rows of fastener elements 4,4 smoothly and stably, with uniform element-to-element pitches, even when relatively strong lateral pulling forces are exerted on the opposed stringers.

Although various minor modifications may be suggested by those versed in the art, it should be understood that I wish to embody within the scope of the patent warranted hereon, all such embodiments as reasonalby and properly come within the scope of my contribution to the art.

What is claimed is:

1. A slider, for a slide fastener including a pair of stringer tapes carrying along their inner longitidunal edges of a pair of rows of fastener elements in a form of coiled plastic filaments of substantially oval contour having upper and lower leg portions and coupling head portions, comprising:

(a) a slider body including a pair of upper and lower wings joined at their front end by a neck to define a Y-shaped guide channel between said upper and lower wings for the passage of the fastener element rows of the slide fastener, said upper wing having an aperture opening into said guide channel, said lower wing having a base and a pair of flanges respectively projecting from opposite lateral edges of said base;

(b) a pair of raised corner ledges on an inner face of said base of said lower wing adjacent to said flanges respectively, each of said corner ledges extending along an inner face of the respective flange through its length and having an inwardly sloping surface engageable with the lower leg portions of the respective fastener element row; and (c) a pair of auxiliary ledges on the inner face of said base of said lower wing adjacent to respective front ends of said flanges, each of said auxiliary ledges having a top surface disposed below said sloping surface of the respective corner ledge for being engageable with the lower leg portion of the respective fastener element row, said auxiliary ledge having a uniform height throughout its whole area and extending from a midportion of the respective corner ledge beyond the front end thereof.

* * * * *